US006969302B1

(12) United States Patent
Hashii

(10) Patent No.: US 6,969,302 B1
(45) Date of Patent: Nov. 29, 2005

(54) SEMICONDUCTOR WAFER GRINDING METHOD

(75) Inventor: Tomohiro Hashii, Imari (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 605 days.

(21) Appl. No.: 09/594,502

(22) Filed: Jun. 16, 2000

(30) Foreign Application Priority Data

Jun. 17, 1999 (JP) ..... 11-170860

(51) Int. Cl.[7] ..... B24B 7/22
(52) U.S. Cl. ..... 451/37; 451/41
(58) Field of Search ..... 451/41, 57, 63, 451/37

(56) References Cited

U.S. PATENT DOCUMENTS 5,827,779 A * 10/1998 Masumura et al. ..... 438/691
5,882,539 A * 3/1999 Hasegawa et al. ..... 216/88
5,897,426 A * 4/1999 Somekh ..... 451/41
5,942,445 A * 8/1999 Kato et al. ..... 438/691
6,022,264 A * 2/2000 Cook et al. ..... 451/37
6,039,631 A * 3/2000 Sato et al. ..... 451/37

FOREIGN PATENT DOCUMENTS

EP 0745456 * 12/1996 ..... 451/57

* cited by examiner

*Primary Examiner*—Robert A. Rose
(74) *Attorney, Agent, or Firm*—Morrison & Foerster LLP

(57) ABSTRACT

To reduce the wafer production cost by grinding a sliced semiconductor wafer at a high accuracy and a high efficiency and supplying the wafer to the next polishing step. A semiconductor wafer is rough ground between grindstones by a fixed grindstone. After rough grinding, finish grinding by free abrasive grain is performed on the same grinding axis by supplying a slurry which suspends fine abrasive grain between the grindstones through slurry pipes. To perform finish grinding by free abrasive grains, a rotational speed and a feed rate of the grindstones are lowered to lower the grinding action by a fixed grindstone.

2 Claims, 1 Drawing Sheet

SEMICONDUCTOR WAFER GRINDING METHOD

FIELD OF THE INVENTION

The present invention relates to a method for grinding a semiconductor wafer cut out from a semiconductor ingot.

BACKGROUND OF THE INVENTION

A semiconductor wafer used to fabricate a semiconductor device is generally manufactured through slicing, grinding, and polishing. That is, a semiconductor ingot that is a material of a semiconductor wafer is sliced by a wire saw or the like to form a thin discoid wafer. In this case, fluctuation occurs in thickness and flatness of a wafer depending on a slicing condition. Moreover, a machining-strain layer in a wafer may increase in size. Therefore, both sides of a wafer cut out from a semiconductor ingot are ground in order to uniform the thickness of the wafer, flatten the wafer, and remove machining-strain layers from the wafer and thereafter, the wafer passes though the polishing and is formed into a product (Japanese Patent Laid-Open Nos. 9-248758, 9-262746, 9-262747, 10-156681, 10-180599, and 10-277898).

The both side grinding of a wafer uses fixed abrasive grains or free abrasive grains. Grinding by fixed abrasive grains grinds a workpiece between so-called grindstones.

Grinding by free abrasive grains grinds a workpiece between rotating surface plates by supplying free abrasive grains between the plates, which is referred to as lapping. It is said that the efficiency of grinding by fixed abrasive grains using a grindstone is exceptionally higher than that of grinding by free abrasive grains.

Grinding by fixed abrasive grains using a grindstone and lapping by free abrasive grains use large diameter abrasive grains because a sliced wafer (wafer to be ground) has a rough surface. In case of grinding by fixed abrasive grains, a holding force for the grindstone tends to increase as the diameter of an abrasive grain increases. Then a surface to be ground is rough, abrasive grains are extremely removed from a grindstone unless the grains have a large diameter and thereby, machining becomes impossible in a short time.

SUMMARY OF THE INVENTION

When large diameter abrasive grains are used to grind both sides of a semiconductor wafer, not only is a sufficient surface roughness not obtained, but also a machining-strain layer is formed in a range of approx. 10 $\mu$m from the surface of the wafer due to the grinding itself. Therefore, it is necessary to finish grind both sides of the wafer by using small diameter abrasive grains before starting grinding in the next step and thereby, the efficiency is inevitably lowered.

To perform finish grinding by fixed abrasive grains, fine fixed abrasive grains are necessary. In case of grinding by fixed abrasive grains, abrasive grains are more violently removed as the grain diameter decreases and thereby, stable machining is difficult. Therefore, a problem occurs that machining becomes unstable.

In case of grinding by fixed abrasive grains, it cannot be avoided that grinding marks are left even if finishing is performed by small diameter abrasive grains. In case of a one-side polishing wafer, an error occurs when chucking the wafer through vacuum attraction if grinding marks are left on the back of a wafer. Therefore, both side grinding by fixed abrasive grains cannot be applied to a one-side polishing wafer. Because a one-side polishing wafer must depend on low efficiency lapping, the efficiency is further lowered.

It is an object of the present invention to provide a semiconductor wafer grinding method capable of efficiently supplying a high quality grinded wafer to polishing in the next step. A semiconductor wafer grinding method consistent with the present invention grinds a semiconductor wafer by fixed abrasive grains and then, continuously grinds the wafer by free abrasive grains on the same grinding axis.

Grinding by free abrasive grains on the same grinding axis is performed by supplying free abrasive grains to a grinding portion in the form of grinding by fixed abrasive grains. That is, grinding by free abrasive grains on the same grinding axis uses a grindstone for grinding by fixed abrasive grains as a surface plate for grinding by free abrasive grains.

To perform grinding by free abrasive grains, it is preferable to lower the grinding action by fixed abrasive grains in order to completely reveal the grinding action. As a specific method for lowering the grinding action by fixed abrasive grains, the following is considered: lowering of a feed rate of a grindstone or a combination between lowering of a feed rate of a grindstone and lowering of a rotational speed. It is preferable to set a feed rate and a rotational speed of a grindstone for grinding by free abrasive grains to 10 to 15% of a feed rate and 5 to 10% of a rotational speed of a grindstone for grinding by fixed abrasive grains. In this connection, it is preferable to set a grindstone feed rate for grinding by fixed abrasive grains to 0.1 to 0.2 mm/min and a grindstone rotational speed to 2,500 to 3,000 rpm.

Using such operations, in a semiconductor wafer grinding method of the present invention, finish grinding is continuously and efficiently performed after rough grinding by fixed abrasive grains without changing grindstones on the same grinding axis.

That is, by rough grinding using large diameter fixed abrasive grains in the first half of grinding, it is possible to machine a sliced semiconductor wafer having a rough surface in a comparatively short time. Moreover, it is possible to flatten the sliced wafer and set the flatness to 1 to 2 $\mu$m in TTV (Total Thickness Variation). Furthermore, by securing a sufficient machining margin through the rough grinding, it is possible to control a machining-strain layer produced through the rough grinding itself to approx. 10 $\mu$m from the surface of the wafer while removing the machining-strain layer produced through slicing.

Moreover, by continuously performing finish grinding itself using small diameter free abrasive grains on the same grinding axis after the rough grinding, it is possible to control a machining-strain layer produced through the finish grinding itself to 2 to 3 $\mu$m from the surface of the wafer while removing the machining-strain layer produced through the rough grinding, and also to make TTV (Total Thickness Variation) $\mu$m or less.

Thus, in case of a semiconductor wafer grinding method of the present invention, a high accuracy grinding wafer is efficiently obtained in one efficient step mainly including grinding using fixed abrasive grains. Moreover, because finish grinding is grinding by free abrasive grains, it is possible to form a satin finished surface necessary for a one-side polishing semiconductor wafer.

It is preferable to set a machining margin in the first half of grinding by fixed abrasive grains so as to be able to completely flatten a sliced wafer and remove a machining-strain layer produced through slicing. Specifically, it is preferable to set the margin to 50 to 60 $\mu$m. Moreover, it is preferable to set a machining margin in the latter half of grinding by free abrasive grains so as to be able to remove the machining-strain layer produced in the first half of grinding. Specifically, it is preferable to set the margin to 10 to 20 μm.

A grain size of #325 to #1000 is preferable for fixed abrasive grains. When a diameter of the fixed abrasive grain is too small, the efficiency lowers and when the diameter is too large, a machining-strain layer produced through the grinding concerned becomes thick and thereby the efficiency extremely lowers in the latter half of the grinding by free abrasive grains. A grain size of #2000 to #8000 is preferable for free abrasive grains. The efficiency lowers when a diameter of the free abrasive grain is too small and a machining-strain layer produced through the grinding concerned becomes thick when the diameter is too large.

A semiconductor wafer grinding method of the present invention can be applied not only to both side grinding of a semiconductor wafer but also to grinding of a chamfered portion.

DETAILED DESCRIPTION OF THE INVENTION

Figure 1:
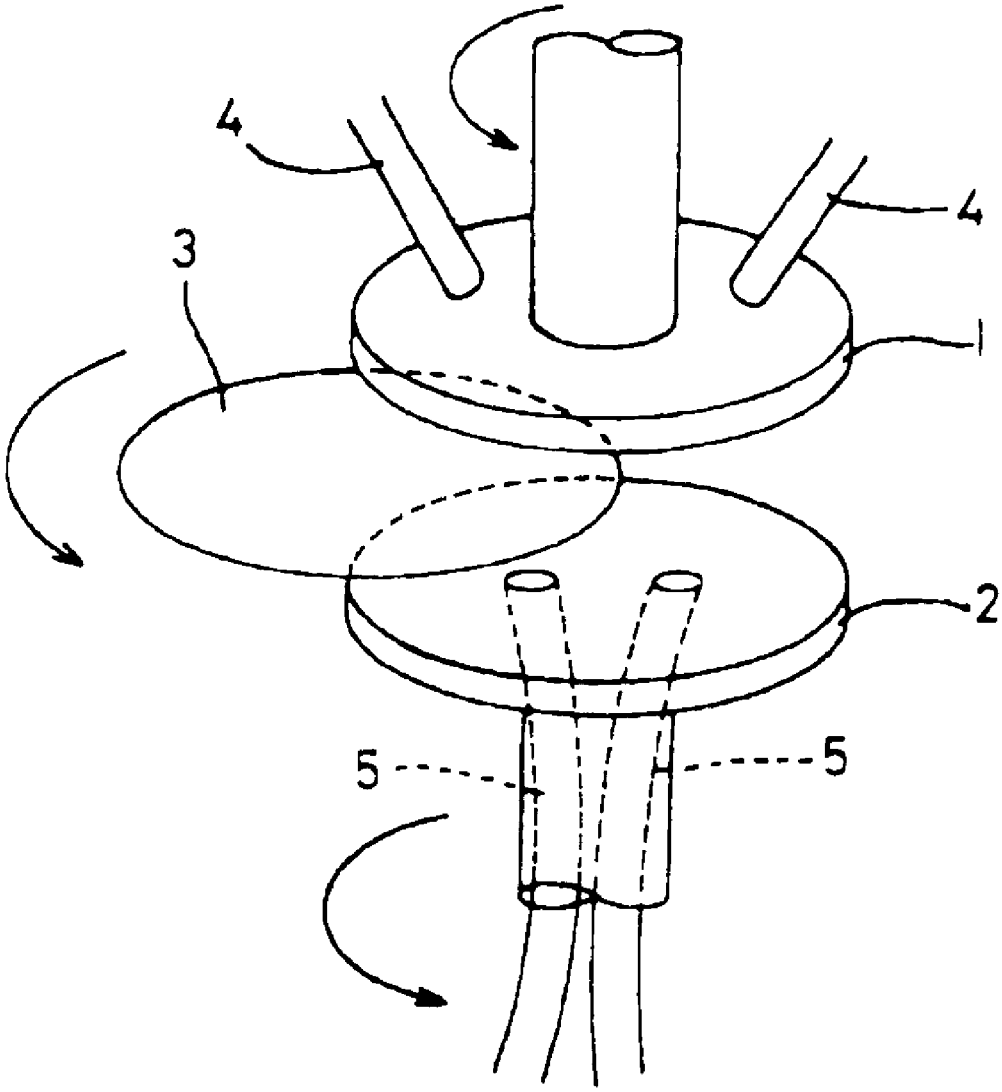
FIG. 1 is a block diagram of a grinder suited to execute a semiconductor wafer grinding method of the present invention.

An embodiment of the present invention will be described below by referring to the accompanying drawing. FIG. 1 is a block diagram of a grinder suitable to execute a semiconductor wafer grinding method of the present invention.

The grinder shown in FIG. 1 is provided with a pair of top and bottom grindstones 1 and 2 arranged on the same line. The grindstones 1 and 2 serving as fixed grindstones rotate in the same direction or opposite directions at a high speed and are feed in the axial direction. A semiconductor wafer 3 serving as a workpiece is held between the grindstones 1 and 2 at a position eccentric to the rotation center of the grindstones 1 and 2 and rotates at a low speed. Thereby, both sides of the semiconductor wafer 3 are roughly ground by fixed abrasive grains.

The upper stage grindstone 1 is equipped with slurry pipes 4 and 4. The slurry pipes 4 and 4 rotate together with the grindstone 1 to supply a slurry which suspends fine abrasive grain, serving as free abrasive grains between the grindstones 1 and 2. The lower stage grindstone 2 is also equipped with slurry pipes 5 and 5. The slurry pipes 5 and 5 rotate together with the grindstone 2 to supply a slurry which suspends fine abrasive grain, serving as free abrasive grains between the grindstones 1 and 2. Thereby, both sides of the semiconductor wafer 3 are simultaneously finish ground by free abrasive grains between the grindstones 1 and 2.

To execute a semiconductor wafer grinding method of the present invention, both sides of the semiconductor wafer 3 are rough ground by rotating the semiconductor wafer 3 between the grindstones 1 and 2 at a low speed while driving the grindstones 1 and 2 at predetermined rotational speed and feed rate. After continuing rough grinding for a predetermined time, both sides of the semiconductor wafer 3 are continuously finish ground on the same grinding axis by continuing rotation of the grindstones 1 and 2 and the semiconductor wafer 3 while supplying a slurry which suspends fine abrasive grain between the grindstones 1 and 2 from the slurry pipes 4 and 4 and 5 and 5.

For finish grinding, the rotational speed and feed rate of the grindstones 1 and 2 are lowered compared to the case of rough grinding.

Thereby, both sides of the semiconductor wafer 3 are efficiently ground up to a necessary high accuracy before polishing without changing grindstones or using a lapping machine together.

Both sides of a silicon wafer having a diameter of 200 mm were actually ground in accordance with the above method.

That is, rough grinding was performed for 90 sec by setting a number of the abrasive grain for the grindstones 1 and 2 to #600, a rotational speed of the grindstones 1 and 2 to 2, 500 rpm, a feed rate of the grindstones 1 and 2 to 0.3 mm/min, a rotational speed of the semiconductor wafer 3 to 10 rpm and thereafter, finish grinding was performed for 60 sec by setting free abrasive grain used for fine abrasive grain slurry to #2, 500, a slurry flow rate to 0.01 $m^3$/min, a rotational speed of the grindstones 1 and 2 to 200 rpm, a feed rate of the grindstones 1 and 2 to 0.02 mm/min, and a rotational speed of the semiconductor wafer to 3 to 10 rpm.

The ground semiconductor wafer was taken out of the grinder to examine the surface roughness and TTV (Total Thickness Variation) of the wafer. Table 1 shows the examination results.

As shown in Table 1, though the surface roughness was 18 μm after slicing, it was improved up to 1 μm. Though TTV (Total Thickness Variation) was 20 μm after slicing, it was improved up to 0.5 μm. The total duration was 2 min 30 sec (90 sec+60 sec).

In this connection, the surface roughness levels off at 3 μm and TTV (Total Thickness Variation) levels off at 1.5 μm only through rough grinding by fixed abrasive grains. To perform finish grinding by free abrasive grains with another equipment after rough grinding by fixed abrasive grains, two types of equipments are necessary and moreover, wafer transfer between equipments is necessary.

Moreover, the total duration when performing all steps from rough grinding up to finish grinding only by free abrasive grains reaches approx. 22 min.

TABLE 1

| | Slicing | Rough grinding (Fixed abrasive grain) | Finish grinding (Free abrasive grain) |
|---|---|---|---|
| Surface roughness (Rmax, μm) | 18 | 3 | 1 |
| TTV (μm) | 20 | 1.5 | 0.5 |

As described above, a semiconductor wafer grinding method of the present invention makes it possible to efficiently supply a high accuracy grinding wafer to the next polishing step by performing grinding by fixed abrasive grains and then performing grinding by free abrasive grains in the same grinding axis. Therefore, it is possible to reduce the wafer production cost, efficiently supply a high accuracy grinded wafer to the next polishing step, and also reduce the production cost.

What is claimed is:

1. A method for grinding semiconductor wafers comprising:

grinding a surface of a semiconductor wafer with fixed abrasive grains and without free abrasive grains;

supplying free abrasive grains to said fixed abrasive grains; and subsequently grinding said surface of a semiconductor wafer with said fixed abrasive grains and said free abrasive grains, wherein said fixed abrasive grains have a larger diameter than said free abrasive grains.

2. The method of claim 1, wherein grinding includes at least one of both sides grinding of a semiconductor wafer and grinding of a chamfered portion.

* * * * *